United States Patent [19]

Fisher et al.

[11] 4,386,656

[45] Jun. 7, 1983

[54] TUBING HANGER LANDING AND ORIENTING TOOL

[75] Inventors: Edmund A. Fisher; Henry W. Miller, both of Houston, Tex.

[73] Assignee: Cameron Iron Works, Inc., Houston, Tex.

[21] Appl. No.: 161,432

[22] Filed: Jun. 20, 1980

[51] Int. Cl.[3] ..... E21B 23/04

[52] U.S. Cl. ..... 166/117.5; 166/212; 166/187

[58] Field of Search ..... 166/117.5, 208, 212, 166/217, 315, 187

[56] References Cited

U.S. PATENT DOCUMENTS 2,881,841 4/1951 Page, Jr. ..... 166/212

3,075,586 1/1963 Schwab et al. ..... 166/117.5

*Primary Examiner*—William F. Pate, III

*Attorney, Agent, or Firm*—Vinson & Elkins

[57] ABSTRACT

A tubing hanger landing and orienting tool for a subsea wellhead having a mandrel connected to the tubing hanger, a sleeve surrounding a portion of the mandrel and being axially movable thereon, a liquid filled chamber between the sleeve and the mandrel, a shoulder on the sleeve adapted to seat in the wellhead, relative movement of the sleeve and the mandrel after seating of the sleeve in the wellhead causing a change of volume in the chamber, means controlling the volume in the chamber to cushion the landing of the tubing hanger, pressure responsive extendible lug in the mandrel which when extended coacts with a cam and slot surface within an orienting spool to orient the tubing hanger in the wellhead, and means for applying pressure from said chamber to extend said lug after seating of the sleeve in the wellhead.

6 Claims, 8 Drawing Figures

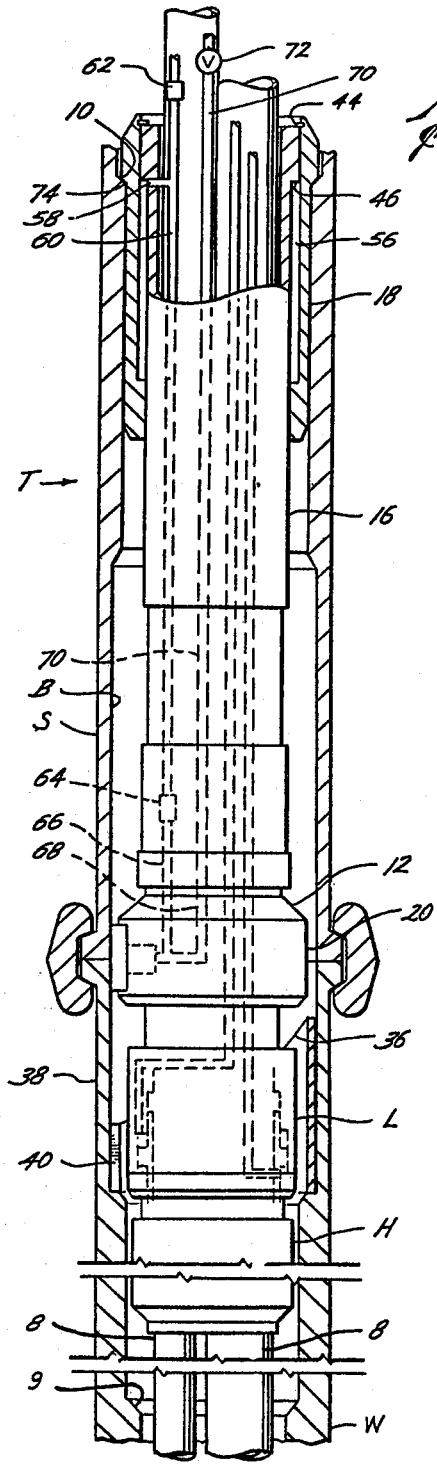
Fig. 1
Fig. 3A
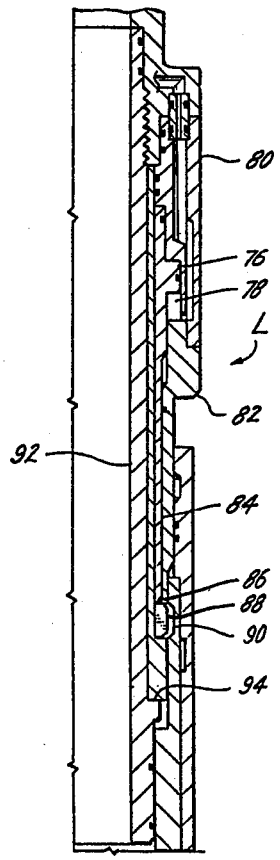

32
24
22
28
30
34
26
12
42
4
4
100
80
78
76
L
82
102
80
92
96
84
86
88
90
94
H
98

12
102
91
91
92
100

TUBING HANGER LANDING AND ORIENTING TOOL

BACKGROUND OF THE INVENTION

The landing of tubing hangers from floating platforms is difficult as the shoulder on the hanger is often jarred on the seat as the result of the heaving of the platform. Orientation of dual string and multiple string tubing hangers is difficult when the outside diameter of the tubing hanger is larger than the conventional orienting bushing which would pass through the blowout preventer stack and the wellhead.

The A. G. Ahlstone U.S. Pat. No. 3,638,725 discloses a tubing hanger having a slidable sleeve which is used for the purpose of providing a seal to the passageway communicating from the interior to the exterior of the hanger mandrel. The S. W. Putch et al U.S. Pat. No. 3,661,206 discloses a dual string tubing hanger which provides for running, landing, pressure testing and locking the hanger down all in one trip. The B. F. Baugh U.S. Pat. No. 3,688,841 discloses a multiple string tubing hanger having a running tool which is oriented with respect to the blowout preventer. The B. F. Baugh U.S. Pat. No. 3,807,497 discloses a tubing hanger utilizing an internal camming spool for providing proper orientation for the multiple strings. The B. F. Baugh U.S. Pat. No. 4,067,062 provides keys on the exterior of a hanger for orientation.

SUMMARY

The present invention relates to an improved tool for lowering a tubing hanger into position in a well bore so that the tubing hanger is oriented properly and is provided with a cushioned or soft landing while imparting minimum movement to the static seals. The improved tool includes a mandrel, a surrounding, axially movable, sleeve, a chamber filled with liquid between the mandrel and sleeve, a shoulder on the sleeve for landing on the seat below the riser flexible joint and releasable latch for connecting to a tubing hanger. The mandrel includes a pressure responsive extendible lug which cooperates with a cam and slot surface in an orienting spool to rotate the hanger to the proper position. The pressure of liquid in the cylinder developed by landing of the sleeve is transmitted to the extension in the lower portion of the mandrel. The pressure is controlled to assure that the lug is engaged within the orienting spool cam and slot and to allow a gradual lowering of the hanger onto the internal head seat.

An object of the present invention is to provide an improved tool for lowering and landing a tubing hanger which prevents the jarring of the tubing hanger on its seat or swabbing its seal in the well bore even though the tool and hanger are suspended from a heaving floating structure.

Another object is to provide an improved tool for lowering and landing a tubing hanger having orienting capabilities without restricting the size of the hanger and without permanent projections therefrom.

BRIEF DESCRIPTION OF THE DRAWINGS

These and other objects and advantages of the present invention are hereinafter set forth and explained with respect to the drawings wherein:

FIG. 1 is a schematic view of the improved device of the present invention as it is being lowered close to a position of seating the tubing hanger on its seat in the wellhead.

FIG. 3A is a view similar to FIG. 3 but showing the unlatched position.

DESCRIPTION OF THE PREFERRED EMBODIMENT

Figure 2:
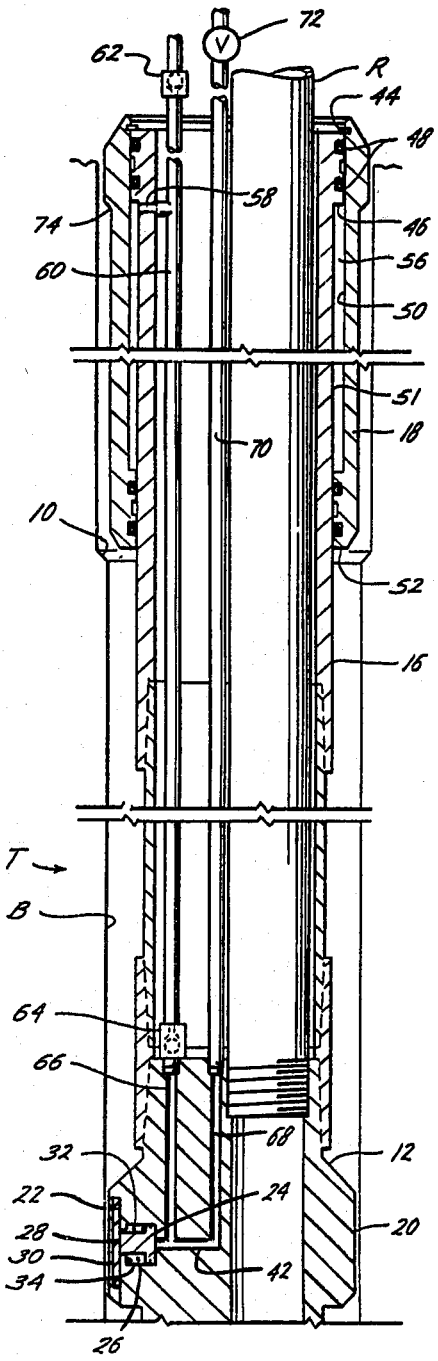
FIG. 2 is an elevation view of a tubing hanger running tool as it is being lowered through a blowout preventer with the shoulder on the tool approaching the shoulder or seat which is positioned below the ball joint or flex joint and at the top of the blowout preventer stack.

Improved tool T of the present invention is shown in FIGS. 1 and 2 as it is being lowered into and through bore B of a blowout preventer stack S.

As shown schematically in FIG. 1 the Tool T is lowered on running string R, with hanger H supported thereon and tubing strings 8 extending below tubing hanger H through blowout preventer stack S into wellhead W. Wellhead W includes internal shoulder 9 onto which hanger H will be soft landed as hereinafter described.

The soft landing is accomplished by providing running tool T with a telescoping joint which is adapted to engage the internal upwardly facing shoulder 10 and then lower hanger H onto shoulder 9. Internal upwardly facing shoulder 10 is positioned below the ball or flex joint of a riser pipe. Tool T includes body 12 which is secured by remote controlled latch means L (FIGS. 3 and 3A) to hanger H, running string R, mandrel 16 connected to body 12 and extending upwardly therefrom and sleeve 18 surrounding the upper end of mandrel 16.

Figure 3:
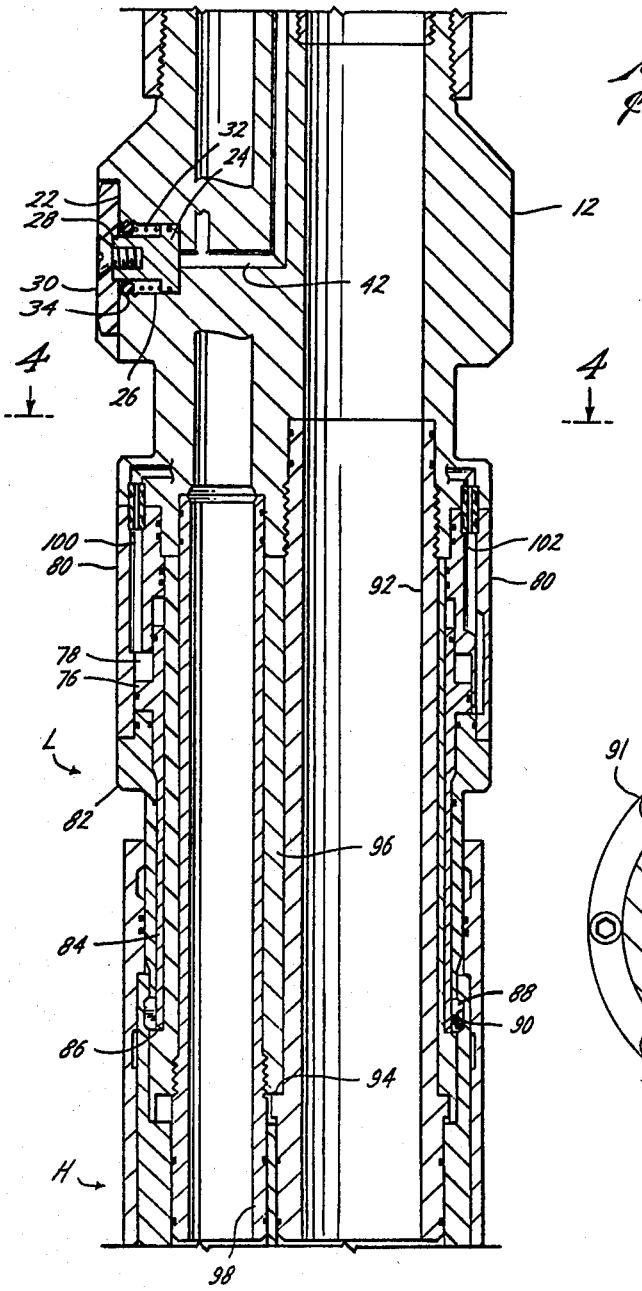
FIG. 3 is a sectional view illustrating the connection of the improved tool of the present invention to a tubing hanger illustrating the latched position.

Body 12 has an enlarged central portion 20 with recess 22 on one side thereof facing outwardly. Piston 24 is positioned in bore 26, which extends inwardly from recess 22, and is connected by rod 28 to orienting lug 30. Spring 32 surrounds rod 28 and is positioned between shoulder 34 and piston 24 to urge piston 24 inwardly and thus urge orienting lug 30 to its retracted position within recess 22 as shown in FIGS. 2 and 3.

Figure 5:
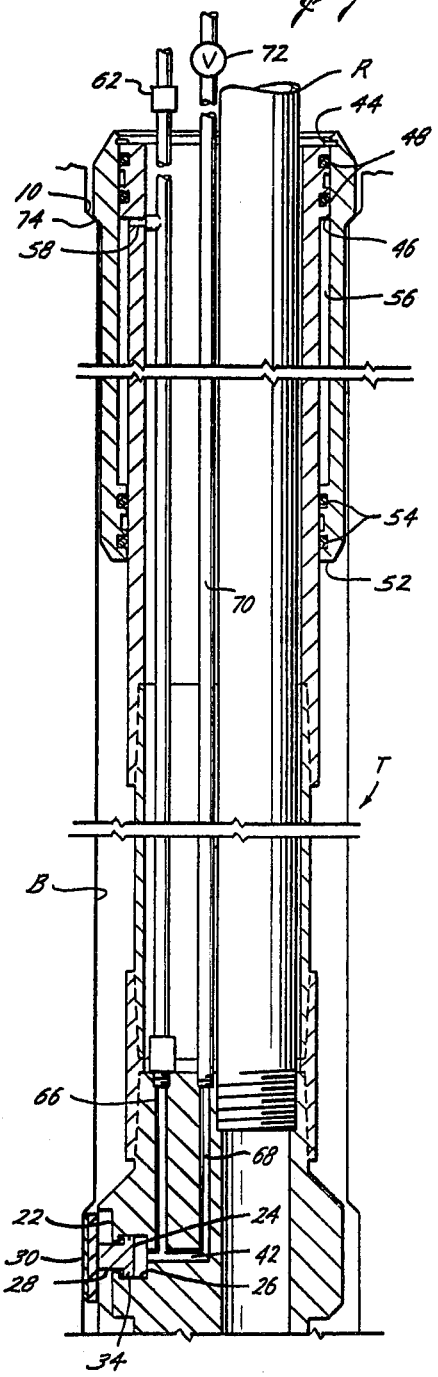
FIG. 5 is an elevation view of the improved tool of the present invention showing the landing of the tool shoulder on the riser flex joint shoulder and the orienting lug positioned in the orienting spool.
Figure 4:
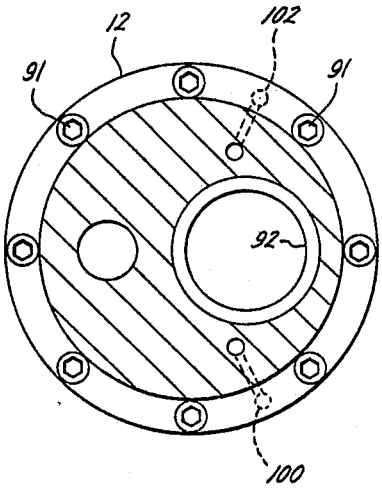
FIG. 4 is a transverse sectional view of the tool taken along line 4—4 in FIG. 3.
Figure 6:
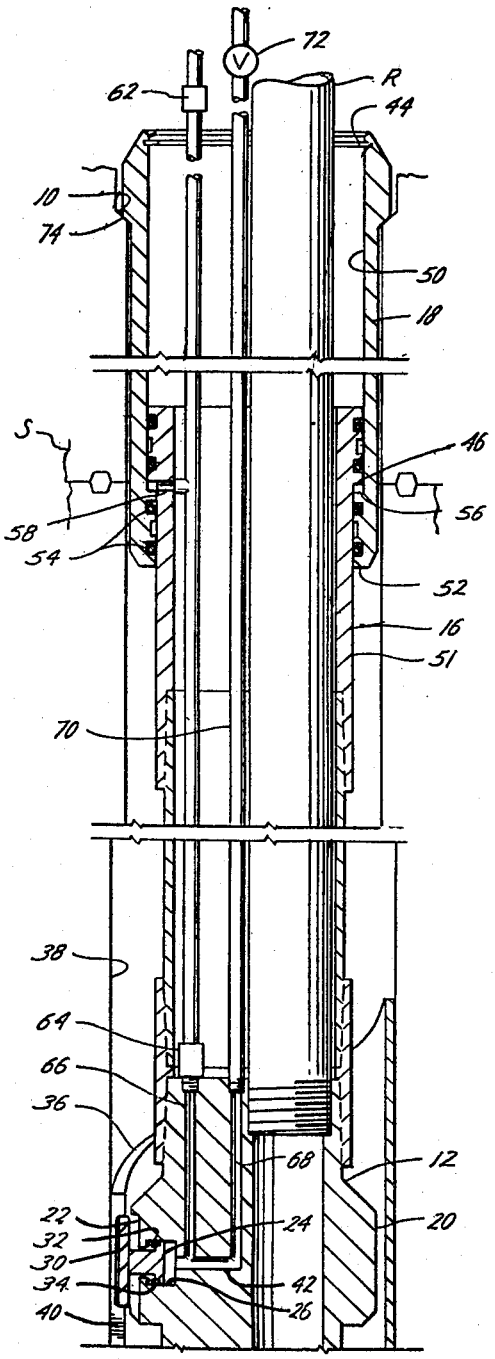
FIG. 6 is another similar elevation view illustrating the entry of the orienting lug into the slot at the lower end of orienting helix which assures the proper positioning of the hanger and with the tool completely lowered.
Figure 7:
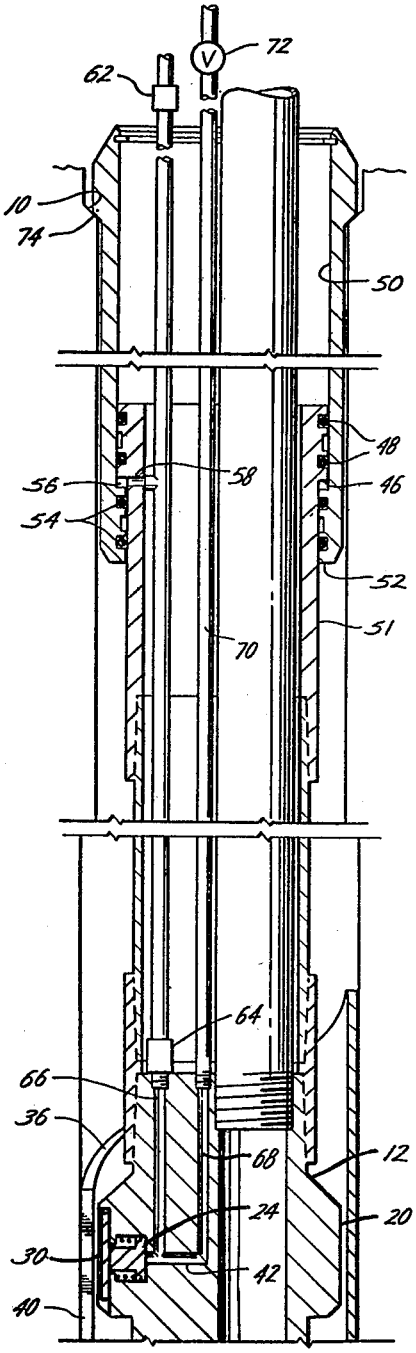
FIG. 7 is another elevation view illustrating the position of the tool preparatory to retrieval of the tool.

Orienting lug 30, when extended as shown in FIGS. 5 and 6, is positioned to coact with orienting helix or internal cam track 36 on the interior of the orienting spool 38 below the blowout preventer stack S and above the wellhead W. Helix 36 curves downward at both sides from its highest point and terminates in vertical slot 40. As hereinafter described, when orienting lug 30 reaches slot 40 hanger H is oriented to its proper position for landing. Liquid under pressure is delivered to bore 26 behind piston 24 through passage 42. Whenever this pressure is sufficient to overcome the force of spring 32 and the friction resisting the movement of piston 24, piston 24 and orienting lug 30 are moved outward to the position shown in FIG. 4. Conversely, spring 32 retracts piston 24 and orienting lug 30 when the force of spring 32 exceeds the pressure force on piston 24 and the friction force.

Sleeve 18 surrounds the upper end of mandrel 16 and is held from sliding fully down on mandrel 16 by the engagement of retaining ring 44, which is positioned partly within a groove in the interior of sleeve 18. Enlargement 46 on the upper exterior of mandrel 16 has a pair of seal rings 48 which seal against interior surface 50 of sleeve 18 and enlargement 52 on the lower interior of sleeve 18 has a pair of seal rings 54 which seal against the exterior surface 51 of mandrel 16. Surface 50 is spaced from surface 51 to provide annular chamber 56 above enlargement 52, below enlargement 46 and between sleeve 18 and mandrel 16. The only communication with chamber 56 is through port 58 which is in communication with line 60. Line 60 extends from relief valve 62, past port 58, and to relief valve 64 which is positioned on body 12 in communication with passage 66. Passage 66 communicates with passage 42 and through passage 68 to line 70 which extends to bleed valve 72 at the surface. Shoulder 74 on the upper exterior of sleeve 18 tapers downward and outward and is adapted to engage and seat on shoulder 10 below the riser flex joint.

Chamber 56 has its maximum size when retaining ring 44 rests on the upper end of mandrel 16. Chamber 56, lines 60, and 70 and passages 42, 58, 66 and 68 are filled with liquid to provide a hydraulic system free of gases. In a preferred embodiment, surface relief valve 62 is set to relieve pressure differentials above a preselected maximum system pressure, such as 1,000 psi. Relief valve 64 is set to a lower differential pressure than valve 62, such as 500 psi, so that a lower pressure is contained in the system beyond relief valve 64 than in line 60 and chamber 56.

Latch L as shown in FIGS. 3 and 3A includes piston 76 which is responsive to pressures within chamber 78. Chamber 78 surrounds piston 76 and is within annular body sub 80. Sleeve 82 extends from within the interior of sub 80 and surrounds extension 84 of piston 76. The lower end of piston extension 84 is tapered at 86 to engage latch ring 88 so that downward movement of piston 76 and extension 84 forces latch ring 88 into groove 90 in hanger H as shown in the left side of FIG. 3 to complete the connection between tool T and hanger H. Bolts 91, shown in FIG. 4, secure body 12 to body sub 80. Latch L is supported from body 12 by tubular member 92 which is threaded into body 12 and includes flange 94 on which housing 96 rests. Housing 96 provides support for latch L and tube 98. Full communication to the tubing strings below hanger H is provided through tool T. Suitable passages 100 and 102 extend through the body 12 and body sub 80 to connect to opposite sides of piston 76 in chamber 78.

In operation, tool T is latched to tubing hanger H at the surface and lowered through a riser (not shown). As hanger H and tool T are run through blowout preventer bore B shoulder 74 approaches shoulder or seat 10. During lowering, bleed valve 72 is closed and chamber 56 is completely filled with a suitable liquid. When shoulder 74 engages seat 10 further movement of tool T causes mandrel 16 to slide downwardly through sleeve 18. This movement reduces the volume of chamber 56 pumping the liquid therein through port 58 and line 60 to relief valves 62 and 64. Relief valve 64 opens when the pressure in line 60 reaches the pressure setting of relief valve 64. The liquid pressure is exerted through relief valve 64 and line 66 to be exerted on piston 24. This causes orienting lug 30 to be extended. Further downward movement is cushioned by the pressure build-up in chamber 56 which is relieved through relief valve 62 when it exceeds the setting of valve 62.

The upperward pressure within chamber 56 is exerted on the enlargement 46 to slow the downward movement of tool T and hanger H. Also, orienting lug 30 projecting from body 12 engages orienting helix 36 and causes tool T and hanger H to be rotated to the proper position for landing which is determined by lug 30 engaging in slot 40. When landing is complete bleed valve 72 is opened to bleed pressure from piston 24 allowing spring 32 to move piston 24 and lug 30 to their retracted positions. After landing pressure applied through the choke and kill lines (not shown) is used to energize the tubing hanger seal assembly and to lock the tubing hanger in place. Then tool T may be released from hanger H by exerting pressure through passage 102 on to the underside of piston 76 so that piston 76 moves upward and withdraws support from behind latch ring 88. Latch ring 88 retracts from groove 90 and then tool T may be retrieved on running string 14.

The improved tool of the present invention provides the cushioning of the landing of the tubing hanger on its seat, utilizes the pressure developed for such cushioning to assure proper positioning of the hanger without requiring orienting devices normally too large to pass through a blowout preventer stack.

What is claimed is:

1. A tubing hanger landing and orienting tool for a subsea wellhead including a blowout preventer stack, comprising a tubular mandrel, means for connecting said mandrel to a tubing hanger, a tubular sleeve surrounding said mandrel and spaced outwardly therefrom to define a chamber therebetween, an external downwardly facing seat on said sleeve for engaging a landing shoulder within the subsea wellhead, means in said mandrel and said sleeve confining a liquid in the chamber so that downward movement of said mandrel within said sleeve after said sleeve seat engages the landing shoulder is resisted by liquid pressure in the chamber, and means controlling the pressure in said chamber to cushion the landing of the hanger.

2. A tool according to claim 1 including means responsive to pressure developed in said chamber to orient the hanger during landing.

3. A tool according to claim 1 including an orienting spool having an internal orienting helix and slot, means connecting the orienting spool below the blowout preventer stack at the wellhead, and means responsive to pressure developed in said chamber for coacting with said orienting helix and slot to orient the hanger while cushioning its landing.

4. A tool according to claim 1 wherein the subsea wellhead has an orienting spool with an internal cam track and includes an orienting lug positioned in a recess in said mandrel below said sleeve and movable outwardly to engage the internal cam track of the orienting spool responsive to pressure, means communicating from said chamber to said orienting lug whereby reduction of the volume of said chamber increases pressure which moves said orienting lug outward, and valve means connected by said communicating means to said chamber to bleed pressure therefrom.

5. A tool according to claim 4 including a pressure relief valve connected to said chamber to control the pressure developed on landing.

6. A tool according to claim 5 including a second pressure relief valve in the communication means between said chamber and said orienting lug, said second relief valve being set to control the pressure delivered to said orienting lug.

* * * * *